United States Patent [19]

Binet et al.

[11] Patent Number: 4,461,660

[45] Date of Patent: Jul. 24, 1984

[54] BULK MANUFACTURE OF EMULSION EXPLOSIVES

[75] Inventors: Rejean Binet, St. Bruno; William E. Cribb, Pointe Claire; Anthony C. F. Edmonds, Burlington; Melvin A. McNicol, Otterburn Park, all of Canada

[73] Assignee: C-I-L Inc., North York, Canada

[21] Appl. No.: 502,297

[22] Filed: Jun. 8, 1983

[30] Foreign Application Priority Data

Jun. 21, 1982 [CA] Canada ..... 405639

[51] Int. Cl.[3] ..... C06B 45/00

[52] U.S. Cl. ..... 149/2; 86/1 R; 86/20 C; 149/46; 149/109.6; 366/57

[58] Field of Search ..... 86/1 R, 20 C; 149/2, 149/46, 109.6; 366/57, 58, 59, 225

[56] References Cited

U.S. PATENT DOCUMENTS

| | | | |
|---|---|---|---|
| 3,424,438 | 1/1969 | Knotts et al. | 86/20 C X |
| 4,287,010 | 9/1981 | Owen | 149/109.6 |

FOREIGN PATENT DOCUMENTS

| | | | |
|---|---|---|---|
| 7714394 | 1/1980 | Sweden | 366/57 |
| 1284375 | 8/1972 | United Kingdom | 366/57 |

*Primary Examiner*—Leland A. Sebastian

*Attorney, Agent, or Firm*—Donald G. Ballantyne

[57] ABSTRACT

A method and apparatus is provided for the efficient and safe manufacture of batch quantities of non-cap-sensitive emulsion explosives. The method employs none of the high shear mixing or homogenizing techniques of the prior art and hence hazards from heat and mechanical breakdown (impact) are eliminated. The method consists of tumbling the oil phase of the emulsion in a rotating, internally baffled mixer and slowly adding thereto the aqueous phase. The resulting emulsion explosive is detonable by boostering in large diameter charges.

8 Claims, 2 Drawing Figures

BULK MANUFACTURE OF EMULSION EXPLOSIVES

Figure 1:
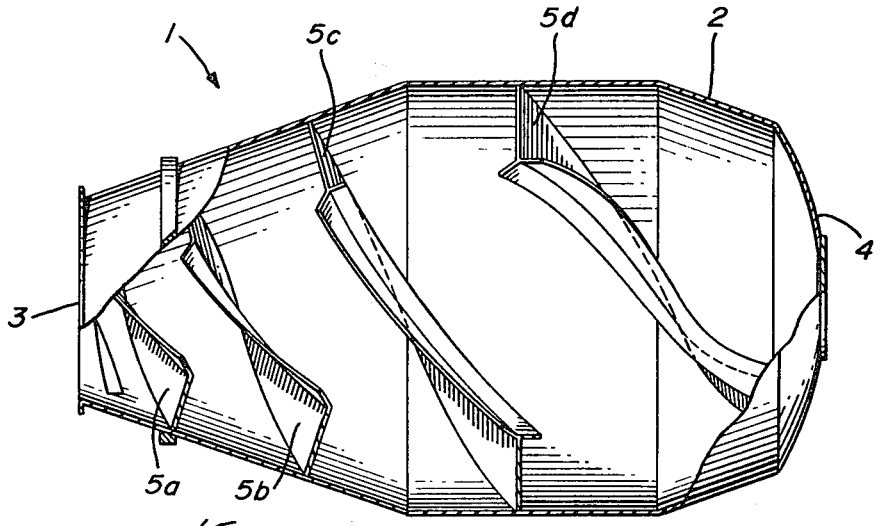

The present invention relates to a method and apparatus for the manufacture of batch or bulk quantities of non-cap-sensitive water-in-oil emulsion explosives. In particular, the invention relates to the batch production of relatively insensitive emulsion explosives employing a mixing zone containing a substantially shearless mixer. By non-cap-sensitive emulsion explosives is meant a composition which is insensitive to initiation by blasting cap and which must be initiated by strong boostering.

Water-in-oil emulsion explosives are now well known in the explosives art and have been demonstrated to be safe, economical and relatively simple to manufacture and to yield excellent blasting results. Bluhm, in U.S. Pat. No. 3,447,978, disclosed an emulsion explosive composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-oil explosives compositions. These include U.S. Pat. No. 3,674,578, Cattermole et al.; U.S. Pat. No. 3,770,522, Tomic; U.S. Pat. No. 3,715,247, Wade; U.S. Pat. No. 3,675,964, Wade; U.S. Pat. No. 4,110,134, Wade; U.S. Pat. No. 4,149,916, Wade; U.S. Pat. No. 4,141,917, Wade; U.S. Pat. No. 4,141,767, Sudweeks & Jessup; Canadian Pat. No. 1,096,173, Binet & Seto; U.S. Pat. No. 4,111,727, Clay; U.S. Pat. No. 4,104,092, Mullay; U.S. Pat. No. 4,231,821, Sudweeks & Lawrence; U.S. Pat. No. 4,218,272, Brockihgton; U.S. Pat. No. 4,138,281, Olney & Wade and U.S. Pat. No. 4,216,040, Sudweeks & Jessup.

Emulsion explosive compositions have been manufactured in commercial quantities by means of both batch and continuous processes employing conventional high shear mixing apparatus. Generally, the prior art has not been specific in suggesting any particular mixing or emulsifying apparatus or techniques, references usually being made merely to "agitation" or "mixing" or "blending" of the aqueous phase and the oil phase in the presence of an emulsifier. Cattermole et al, in U.S. Pat. No. Re. 28060, refer to the use of a turbine mixer. Chrisp, in U.S. Pat. No. 4,008,108, refers to a high shear mixer, that is, a shear pump. Olney, in U.S. Pat. No. 4,138,281, suggests the possible use of a continuous recycle mixer, for example, the VOTATOR (Reg TM) mixer, an in-line mixer, for example, the TURBON (Reg TM) and a colloid type mixer, for example, the OAKES (Reg TM). In recent Canadian Pat. No. 1,106,835, Aanonsen et al describe the use of a mixing unit comprising a turbine-shaped mixing rotor or impeller encased in a housing. In co-pending Canadian Application No. 395,372 use is made of a recirculation loop containing a pump and an in-line motionless mixer for the continuous production of explosive emulsion precursors. In U.S. Pat. No. 4,287,010, J. H. Owen makes use of a blade mixer having a blade tip speed of up to 600 cm/sec. In U.S. Pat. No. 4,231,821, Sudweeks et al employ a colloid mill for the production of small droplet emulsions of improved rheology.

The choice of an appropriate mixer for the manufacture of emulsion explosive compositions will depend, in large part, upon three principal considerations; firstly, the desired sensitivity of the final product; secondly, the type of operation, whether batch-wise or continuous; and, thirdly, safety. The monetary or investment considerations are self-evident. Where the objective is to produce a very small droplet size and, hence, sensitive emulsion explosive designed for blasting cap initiation, a very high shear mixing apparatus will generally be the apparatus of choice. However, use of high shear mixing apparatus for explosive compositions carries an accompanying hazard because of risk of mechanical failure and impact and the generation of heat. Capital investment is also often high. Where non-cap-sensitive emulsion explosives are to be manufactured, a medium or moderate shear mixer is normally chosen which type of mixer possesses most of the disadvantages of a high shear apparatus. If the explosives manufacturing operation is to be continuous, both medium and high shear mixers can be generally employed for such purposes. The use of in-line motionless mixers may also be conveniently adapted for continuous manufacture. Where manufacture of emulsion explosive is batch-wise, similar high or medium shear mixers either alone or in combination with homogenizers, such as a colloid mill, has been deemed essential in order to provide a composition having a uniform distribution of fine droplets. Without such a character, the compositions generally lack utility as explosives.

Non-cap-sensitive explosive emulsions which are normally destined for use in the form of large diameter packages or borehole charges (7 cm. diameter or greater), are most conveniently manufactured in batch quantities. By employing batch manufacture, as opposed to continuous manufacture, the careful proportioned metering of the oil/fuel phase and the aqueous/salt phase is avoided and the quality of the finished product is, therefore, more easily maintained. In particular, phase inversion is more readily avoided in batch processing. Nevertheless, it has been the practice in batch emulsion explosive manufacture to employ the same high shear or relatively high shear mixers as are used in continuous manufacture in order to achieve the desired product homogeneity heretofore noted. Consequently, the problems associated with the use of rapidly rotating mixing devices, namely, heat generation, mechanical breakdown and high capital and operating costs, persist.

It has now been found that high quality, stable, non-cap-sensitive explosive emulsion can be prepared in batch quantities without the use of any high shear mixing apparatus. It has also been found that the method and apparatus of the invention as hereinafter described may be employed either at a fixed (factory) location or may be employed mounted upon a mobile carrier for manufacture of the explosives directly at the blasting site. Furthermore, the method and apparatus of the invention permit the production of a stable, very high phase ratio water-in-oil emulsion (up to 95% water phase) without phase inversion.

The method of the invention comprises the steps of introducing a measured quantity of an oil/surfactant phase into an internally baffled, substantially cylindrical, reversibly rotatable drum mixer having an internal diameter of at least 1.5 meter and preferably 1.5 to 2.5 meter, and rotating said drum mixer about its longitudinal axis at between 8–16 revolutions per minute, while adding thereto a measured quantity of an aqueous phase, the said aqueous phase addition being made continuously over a period of not less than 10 minutes to permit a free fall of material within the drum at a drop velocity of 5 to 7 meter/second to produce an emulsified explosive having a droplet size distribution of from 1–10 μm.

The batch mixer apparatus of the invention consists of a substantially cylindrical shell having a longitudinal axis, a closed end and an open end for receiving material to be mixed and for discharging mixed material, said shell being reversibly rotatable about said axis, and a plurality of spaced-apart, projecting inclined baffles positioned on an inner wall of said shell, said baffles being disposed generally transversely of the said shell axis, the said baffles being positioned so that upon clockwise rotation of said shell, flowable material within said shell is moved towards the said closed shell end and upon counterclockwise rotation, material is moved towards and through the said open shell end, the said projecting portion of said baffles providing a means to lift material within said shell to the apex of shell rotation and to release said material to fall by gravity to the base of said shell.

Figure 2:
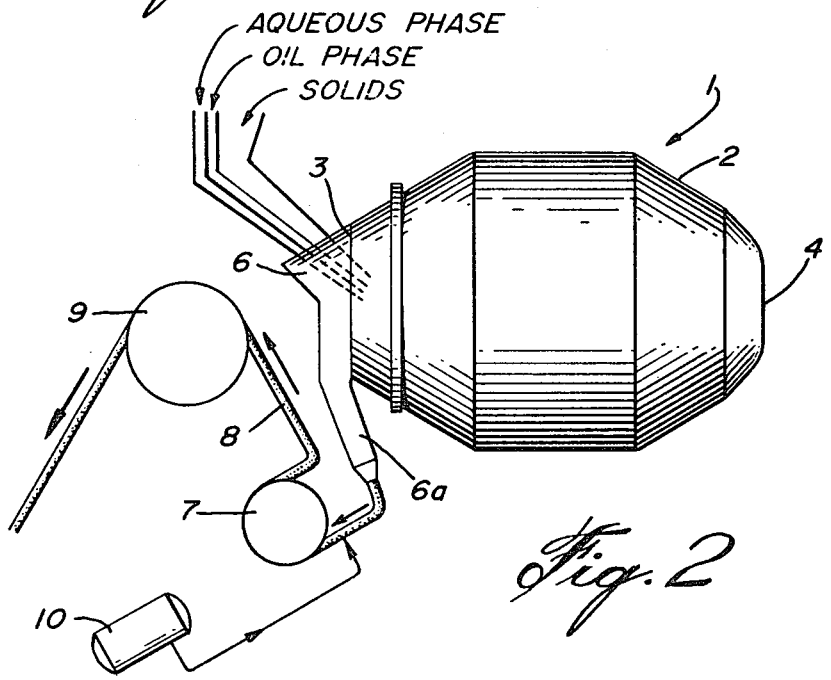

To provide a better understanding of the invention, reference is made to the accompanying drawing wherein:

FIG. 1 shows a perspective view, partly broken away, of the mixer apparatus of the invention; and FIG. 2 shows a diagrammatic or schematic representation of the process of the invention.

Referring to the drawings, the explosive emulsion mixer apparatus of the invention which is generally indicated by reference numeral 1, includes a hollow, generally cylindrical rotatable housing or shell 2 preferably of welded metal construction, having an open end 3 and a closed end 4. Fixed, preferably by welding, to the mixer inner walls of shell 2 are a series of diagonally disposed blades or flights 5 which are arranged to direct flowable material within shell 2 towards closed end 4 when shell 2 is in clockwise rotation. Flights 5*c* and 5*d* are more particularly arranged to mainly elevate flowable material during rotation and, at the apex, to allow the flowable material to drop away and fall to the base of shell 2.

Referring particularly to FIG. 2, a hopper 6 is shown adjacent to open end 3 of shell 2. Passing through hopper 6 and into opening 3 are delivery conduits, as shown, for the various components of the emulsion explosive composition. The lower portion 6*a* of hopper 6 acts as a collector for the emulsified composition after mixing has been completed. A pump 7 is conveniently provided to withdraw the mixed emulsions from hopper 6*a* after which the emulsion is passed through hose 8 mounted on hose reel 9. An additive reservoir 10 containing, for example, a gassing agent is located for delivery of its product to the emulsion at a point close to pump 7. Alternatively, the mixed emulsion may be withdrawn from hopper 6*a* by gravity methods.

The emulsification of aqueous and oil phases within shell 2 is achieved by low speed rotation of the shell, rotation being accomplished, for example, by means of a hydraulic motor (not shown) or other known methods. After the placing of the components of the emulsion composition in the shell, as hereinafter described, the shell is rotated at slow speed, for example, about 8–16 rmp., for a period sufficiently long to produce a water-in-oil emulsion of desired droplet size. After the mixing period, the direction of rotation of shell 2 is reversed and the internal flights 5 move the emulsified composition through opening 3 and into hopper 6*a* from where it is removed either by pumping or gravity.

In the operation of the method and apparatus of the invention, a premeasured or preweighed oil phase is first introduced into shell 2 and slow clockwise rotation, about 10 rpm., of shell 2 is begun. The premeasured aqueous phase is then gradually added to the oil phase over a period of from 10–60 minutes depending onthe size of the latch being prepared. It has been found that if the addition of the aqueous phase is hurried, for example, in less than 10 minutes, the required small droplet size required in the final product may not be achieved. The combination of slow addition and long residual time in a low shear mixing apparatus produces an emulsion explosive composition having a droplet size distribution of about 1–10 μm with an average about 4 μm. Such a droplet size distribution provides an explosive product of excellent stability and rheology yet one which is insensitive to initiation by electric blasting cap. After mixing to the desired droplet size distribution, particulate solids or dopes, for example, particulate oxygen-supplying salts, such as prilled ammonium nitrate or particulate light metal may be added to shell 2 and incorporated into the emulsion. The direction of rotation of shell 2 is thereafter reversed and the contents delivered through opening 3 and deposited in hopper 6*a*.

EXAMPLE I 300 kilograms of a hot (60° C.) oil phase was placed into a 7.6 cubic meter capacity mixing shell. The oil phase consisted of 45 part paraffin oil, 26 part paraffin wax and 20 part emulsifier. The shell was rotated in clockwise rotation at 10 rpm. while 3307 kilograms of a hot (70° C.) aqueous salt solution phase was added over a period of 20 minutes. The aqueous phase consisted of 15.35% by weight of water, 61.63% ammonium nitrate, 19.75% sodium nitrate and 0.27% zinc nitrate. After addition of the aqueous phase was completed, the resulting emulsion was mixed at 10 rpm. for a further 10 minutes. The rotation rate was then reduced to 2 rpm. and 907 kilograms of particulate ammonium nitrate was added and blended into the emulsion. Rotation of the mixing shell was reversed and the mixed composition collected in a hopper from which it was packaged into plastic bag-like containers with the addition of sodium nitrite to generate some nitrogen bubbles. The composition was insensitive to initiation by electric blasting cap and had a density of 1.10. Upon detonation by means of a 60 gram pentolite booster in 16.5 cm. diameter charges, the composition had a velocity of detonation of 4800 m.p.s., which value was unchanged after 3 weeks storage at 5° C.

It will be appreciated by those skilled in the art that the non-cap-sensitive product heretofore described may be rendered sensitive to cap initiation by the incorporation of density lowering ingredients, such as further gas bubbles, glass or resin micropheres, vermiculite and the like, or by the incorporation of self-explosives such as, for example, particulate TNT.

EXAMPLE II 193 kilograms of a hot (60° C.) oil phase was placed into a 7.6 cubic meter capacity mixing shell. This oil phase consisted of 28 parts emulsifier, 41 parts paraffin oil and 31 parts paraffin wax. As in Example I, 3003 kilograms of a hot aqueous phase with the same composition as Example I was added over 25 minutes with the mixer rotating at 12 rpm. After addition of the aqueous phase was completed, the resulting emulsion was mixed at 10 rpm for 10 minutes. The rotation rate was then reduced to 2 rpm and 750 kilograms of particulate TNT was added and blended into the emulsion. The product was discharged as for Example I directly into boreholes, except that no gassing agent was added. The density was 1.50. The product was kept for 3 weeks and upon detonation by means of a 450 g pentolite/TNT booster in 20 cm. diameter boreholes had a velocity of detonation of 4.8 km $s^{-1}$. A similar product in 12.7 cm. diameter packages shoots when initiated with 230 g of pentolite.

EXAMPLE III

An emulsion explosive was made as for Example I except that 308 kilograms of an oil phase containing 22% surfactant, 45% paraffin oil and 33% wax was used. To this was added 4205 kilograms of an AN/SN/ZN/$H_2O$ liquor as for Example I. The product was mixed and discharged directly to a borehole with addition of $NaNO_2$ to produce gassing and lower the density to 1.10 g/cc. Upon detonation with a 450 g booster the product had a velocity of detonation of 5.5 km $s^{-s}$ in 20 cm. diameter boreholes.

It is postulated that the surprising and unexpected production of very small droplet emulsion explosives by employing a baffled, rotating shell, batch mixer is due to a combination of turbulence and vortexing which occurs during mixing. The rotation of the shell causes the fluid contents to flow over the baffles or flights and to fall by gravity to the pool of material below. Such flow and splashing and the turbulence resulting therefrom cause vortices and whirlpools of a range of sizes which results in the production of droplets of a corresponding range of sizes.

Where the mixer apparatus of the invention is mounted at a fixed location, the various liquid components or phases of the emulsion explosives composition can be prepared in separate heated mixers of conventional construction, e.g., paddle mixers. These phases can then be added to the emulsion mixer in preweighed or premeasured quantities as hereinbefore described. Similarly, any solid ingredients or dopes can be added from, for example, volumetric storage bins or weigh hoppers.

Where on-site mixing is performed, the mixer apparatus of the invention can be mounted upon a vehicle or a vehicle-pulled trailer. The liquid phases and solid additives can be carried in premeasured amounts in insulated and/or heated storage containers mounted upon the vehicle or trailer or carried on a separate nurse vehicle. After the emulsion has been prepared in a batch quantity, the mixer vehicle can move from borehole to borehole until all holes are filled or until the supply of mixed explosives is exhausted.

We claim:

1. A method of manufacture of a high phase ratio water-in-oil emulsion explosive composition which is insensitive to blasting cap initiation comprising the steps of:

(a) introducing a measured quantity of an oil/surfactant phase into an internally baffled, substantially cylindrical, reversibly rotatable drum mixer having an internal diameter of at least 1.5 meter and preferably 1.5 to 2.5 meter, (b) rotating said drum mixer about its longitudinal axis at between 8–16 revolutions per minute, while adding thereto a measured quantity of an aqueous phase, the said aqueous phase addition being made continuously over a period of not less than 10 minutes to permit a free fall of material within the drum at a drop velocity of 5 to 7 meter/second to produce an emulsified explosive having a droplet size distribution of from 1–10 $\mu$m.

2. A method as claimed in claim 1 also comprising the step of adding to the said emulsified explosive measured quantities of particulate solid materials.

3. A method as claimed in claim 1 also comprising the step of incorporating into said emulsifier explosive a density reducing agent.

4. A method as claimed in claim 2 wherein the said particulate solid material is selected from oxygen supplying salts, light metals and self explosives.

5. A method as claimed in claim 3 wherein the said density reducing agent comprises gas bubbles, void-containing particulate material or mixtures of these.

6. A batch mixer for the manufacture of non-cap-sensitive water-in-oil emulsion explosives comprising:

(a) a substantially cylindrical shell having a longitudinal axis, a closed end and an open end for receiving material to be mixed and for discharging mixed material, said shell having an internal diameter of at least 1.5 meter and preferably 1.5 to 2.5 meter being reversibly rotatable about said axis, and (b) a plurality of spaced-apart, projecting inclined baffles positioned on an inner wall of said shell, said baffles being disposed generally transversely of the said shell axis, the said baffles being positioned so that upon clockwise rotation of said shell, flowable material within said shell is moved towards the said closed shell end and upon counterclockwise rotation, material is moved towards and through the said open shell end, the said projecting portion of said baffles providing a means to lift material within said shell to the apex of shell rotation and to release said material to fall by gravity to the base of said shell at a drop velocity of from 5 to 7 meter/-second.

7. A mixer apparatus as claimed in claim 6 also comprising a receiver means adjacent the said shell open end for collection therein of mixed emulsion explosive moved through the said shell open end, said receiver means having directional means on the base thereof for delivering said collected emulsion to a selected locality.

8. A mixer as claimed in claim 6 wherein the drum internal diameter is 1.5 to 2.5 meter.

* * * * *